US005366110A

United States Patent [19]

Takemoto et al.

[11] Patent Number: 5,366,110

[45] Date of Patent: Nov. 22, 1994

[54] GAME TOKEN DISPENSER

[75] Inventors: Takatoshi Takemoto, Tokyo; Yoshihide Kurihara, Hanamaki; Koshiro Nakai, Hanamaki; Sakuji Yaegashi, Hanamaki; Hiroyasu Obara, Hanamaki; Mitsuhiro Tada, Hanamaki, all of Japan

[73] Assignee: Kabushiki Kaisha Ace Denken, Tokyo, Japan

[21] Appl. No.: 915,718

[22] PCT Filed: Nov. 19, 1991

[86] PCT No.: PCT/JP91/01654

§ 371 Date: Jul. 28, 1992

§ 102(e) Date: Jul. 28, 1992

[87] PCT Pub. No.: WO92/09346

PCT Pub. Date: Nov. 6, 1992

[30] Foreign Application Priority Data

Nov. 29, 1990 [JP] Japan ..... 2-333224
Nov. 29, 1990 [JP] Japan ..... 2-333226
Nov. 29, 1990 [JP] Japan ..... 2-333228

[51] Int. Cl.[5] ..... G07F 11/00

[52] U.S. Cl. ..... 221/2; 221/8; 221/13; 221/21; 221/92; 221/195; 221/206; 453/17; 453/32

[58] Field of Search ..... 221/2, 8, 10, 11, 13, 221/21, 92, 97, 191, 194, 195, 206, 207, 224, 225, 236, 258, 259, 277; 453/17, 32, 57

[56] References Cited

U.S. PATENT DOCUMENTS 4,480,651 11/1984 Nakai et al. ..... 221/10 X
4,541,444 9/1985 Okada ..... 453/17
4,810,230 3/1989 Shirasawa ..... 453/57
4,822,318 4/1989 Okada ..... 453/57

FOREIGN PATENT DOCUMENTS

0209357A2 1/1987 European Pat. Off. .
59-188476 12/1984 Japan .
2-18178 2/1990 Japan .
2-63890 5/1990 Japan .
2-109685 9/1990 Japan .
2117954A 10/1983 United Kingdom .

*Primary Examiner*—David H. Bollinger
*Attorney, Agent, or Firm*—Lowe, Price, LeBlanc & Becker

[57] ABSTRACT

A game token dispenser is equipped with a token hopper for dispensing, to a token receiving port, a predetermined number of tokens supplied from a token reservoir. The token hopper is divided into a sequentially operating preliminary hopper and a dispensing hopper. The preliminary hopper has a sensor for detecting whether or not there are any tokens received from the reservoir, and a conveying mechanism for conveying the tokens forwardly. The dispensing hopper has a sensor for detecting whether or not there are any tokens received from the preliminary hopper. A discharging mechanism is provided for discharging the tokens one by one to the token receiving port. The dispenser preferably includes a display, on a front surface of a housing, for displaying whether or not it is possible to dispense the tokens and the number of the tokens dispensed. The dispenser preferably also includes a counting sensor disposed in a dispensing path between the dispensing hopper and the token receiving port for counting the tokens dispensed. The dispenser may also include a sensor located adjacent to the token receiving port for detecting whether the tokens overlap one another. This latter sensor may also be capable of sensing whether or not the tokens are stored in the token receiving port for a predetermined time. When the predetermined number of tokens, as counted by the counting sensor, are dispensed, upon detection that the tokens are stored in the token receiving port the dispenser displays an information message such as "now dispensing", and any paper currency can be prohibited from being inserted into the dispenser.

12 Claims, 8 Drawing Sheets

GAME TOKEN DISPENSER

FIELD OF THE INVENTION

This invention relates to a game token dispenser for supplying tokens from a token reservoir to individual token dispensing apparatuses installed next to game machines such as slot machines and for rendering the individual dispensing apparatuses able to dispense the tokens.

BACKGROUND OF THE PRIOR ART

In a typical conventional game token dispenser equipped with a token hopper for dispensing a predetermined number of tokens, which are received from a token reservoir, to a token receiving port, the token hopper has a single-hopper structure.

However, with this single token hopper, while the received tokens are stored prior to being dispensed, the pressure of the tokens acts directly on a rotary drum and other associated parts so that the tokens tends to get clogged. Therefore a predetermined number of tokens equivalent to a desired amount of money can not be dispensed smoothly, thus inconveniencing the clientele.

In another conventional game token dispenser equipped with a dispensing hopper for dispensing a predetermined number of tokens one by one to a token receiving port when supplied from a token reservoir, a predetermined number of tokens equivalent to the amount of money inserted can be dispensed.

However, the second-named dispenser must be additionally equipped with a detecting means in the individual token path to identify a position where the tokens have become clogged, which would tend to occur. Because of many such sensors, precise counting of the dispensed tokens is difficult to achieve, thus also troubling the clientele.

In still another conventional game token dispenser equipped with a hopper for dispensing a predetermined number of tokens, which are supplied from a token reservoir, one by one to a token receiving port, the dispensed tokens not only would tend to bounce out of a receiving tray but must also be collected by hand.

However, since there is no discrimination made as to whether or not the dispensed tokens have all been taken out of the receiving port, it is possible that the next dispensing operation would be made so that excessive tokens flow over the receiving port, thus causing a fault.

SUMMARY OF THE INVENTION

With the foregoing problems in mind, it is a principal object of this invention to provide a game token dispenser which can dispense tokens quickly and accurately. This object can be accomplished according to a preferred embodiment by a game token dispenser equipped with a token hopper for dispensing to a token receiving port a predetermined number of tokens supplied from a token reservoir, wherein the token hopper is divided into a preliminary hopper and a dispensing hopper, which function in sequence, the preliminary hopper having a sensor for detecting whether or not there is any token received from the reservoir, and means for conveying the token forwardly, the dispensing hopper having a sensor for detecting whether or not there is any token received from the preliminary hopper, and means for discharging the tokens one by one to the token receiving port.

The conveying means may be a conveyer belt, and the discharging means may include a rotary drum and a ring-shape friction belt wound around a circumferential surface of the rotary drum.

With this arrangement, as tokens are supplied from the token reservoir to the token hopper, a constant amount of tokens are received and stored by the preliminary hopper. Then when tokens are conveyed to the dispensing hopper as its amount is being detected, it is possible to discharge the tokens one by one to the token receiving port reliably in the best dispensing condition so that the correct number of tokens can be discharged.

Another object of the invention is to provide a game token dispenser which enables precise counting of tokens dispensed and displaying of the counted number of tokens as well as quick realization that the tokens have become clogged. This object can be accomplished by a game token dispenser equipped with a upstream preliminary hopper, to which tokens are to be supplied from a token reservoir, and a dispensing hopper for discharging a predetermined number of the tokens, which are received from the preliminary hopper, one by one to a token receiving port, characterized in that the dispenser further includes a display on the front surface of a housing for displaying whether or not it is possible to dispense the tokens and the number of the tokens dispensed, and a counting sensor disposed in a dispensing path between the dispensing hopper and the token receiving port for counting the tokens dispensed.

Further, three sensors, each for detecting the tokens, may be disposed respectively adjacent to the preliminary hopper, the dispensing hopper and the token receiving port, and an openable and closable shutter for stopping the tokens from being dispensed may be disposed between the dispensing hopper and the counting sensor. In addition, a position at which the tokens get clogged may be discriminated by the individual sensor, and displayed.

With this arrangement, while tokens to be dispensed pass through the dispensing path, the counting sensors counts the tokens reliably and, at the same time, the display indicates the number of tokens dispensed. Further, each of the sensors disposed respectively adjacent to the two hoppers and the token receiving port detects the presence/absence of tokens. When a problem arises, the shutter closes to stop the tokens from being dispensed and, at the same time, the position where any tokens got clogged is indicated on the display, so that an arcade keeper can take appropriate measures to solve the problem.

Still another object of the invention is to provide a game token dispenser which enables continuous dispensing of tokens up to two times, thus improving service to clientele. This object can be accomplished by a game token dispenser equipped with a hopper for dispensing a predetermined number of tokens, which are received from a token reservoir, one by one to a token receiving port, characterized in that the dispenser further includes a counting sensor disposed in a dispensing path between the dispensing hopper and the token receiving port for counting the tokens dispensed, and a sensor disposed adjacent to the token receiving port for detecting whether the tokens overlap one another. The sensor disposed next to token receiving port can thus discriminate whether or not the tokens have remained in the token receiving port for a predetermined time, and when a predetermined number of the tokens are dispensed and stored in the token receiving port, the dispenser displays an information message such as "now dispensing" and any paper currency can be prohibited from being inserted into the dispenser.

With this arrangement, if continuous dispensing is to be done with the previously dispensed tokens left not taken out the token receiving port, dispensing of tokens can be done up to two times whereupon any further token dispensing and any further money inserting will be prohibited and, at the same time, clientele will be urged to take out the tokens in the port, thus keeping the dispenser free from any trouble due to the overflow of tokens.

DETAILED DESCRIPTION OF THE PREFERRED EMBODIMENTS

Figure 1:
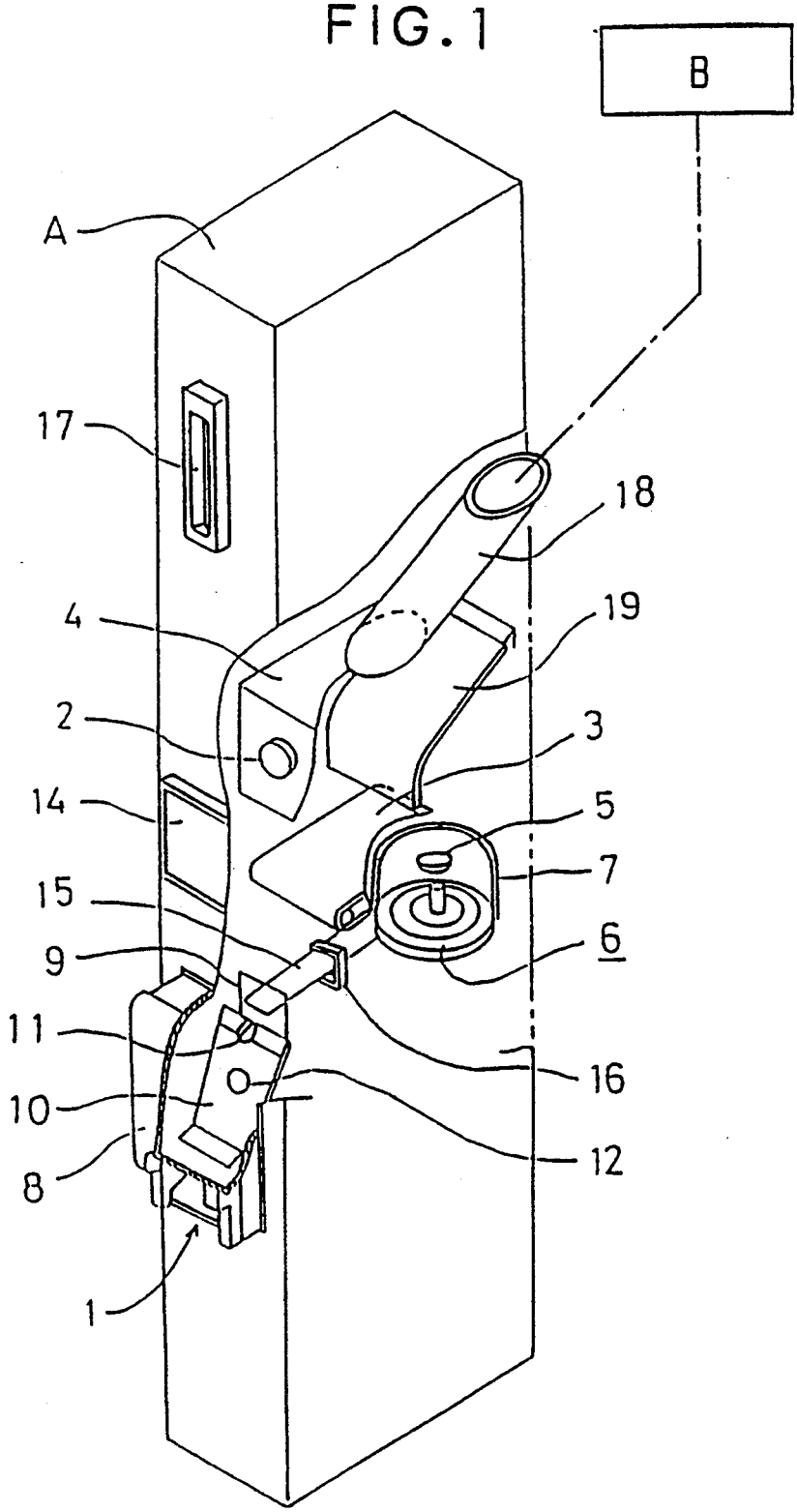
FIG. 1 is a perspective view showing a main portion of a game token dispenser according to one embodiment of this invention.
Figure 2:
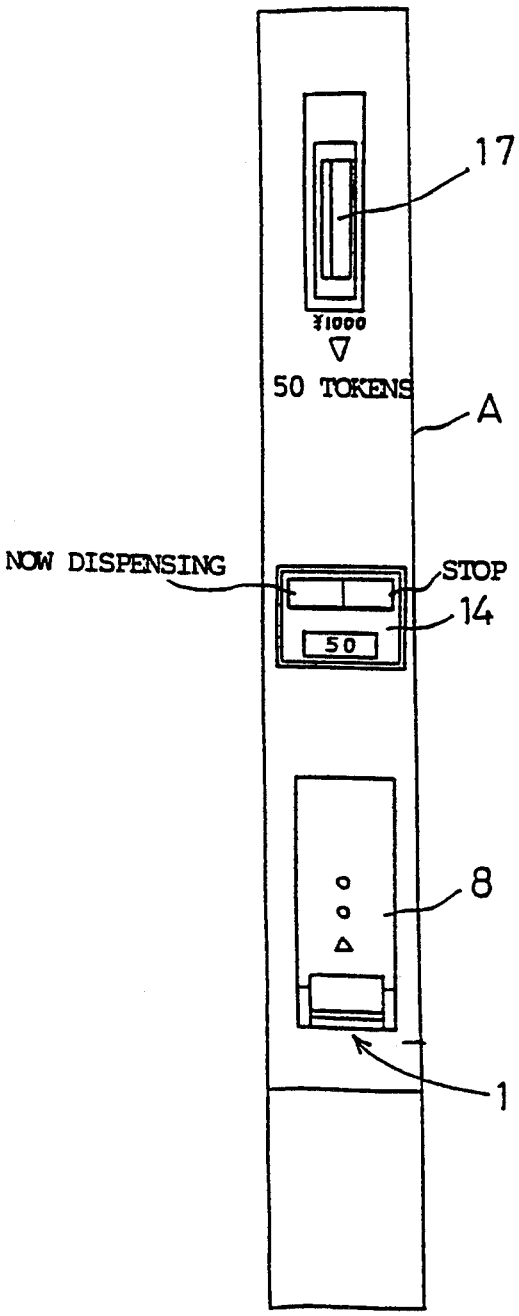
FIG. 2 is a front view showing the token dispenser of FIG. 1.
Figure 3:
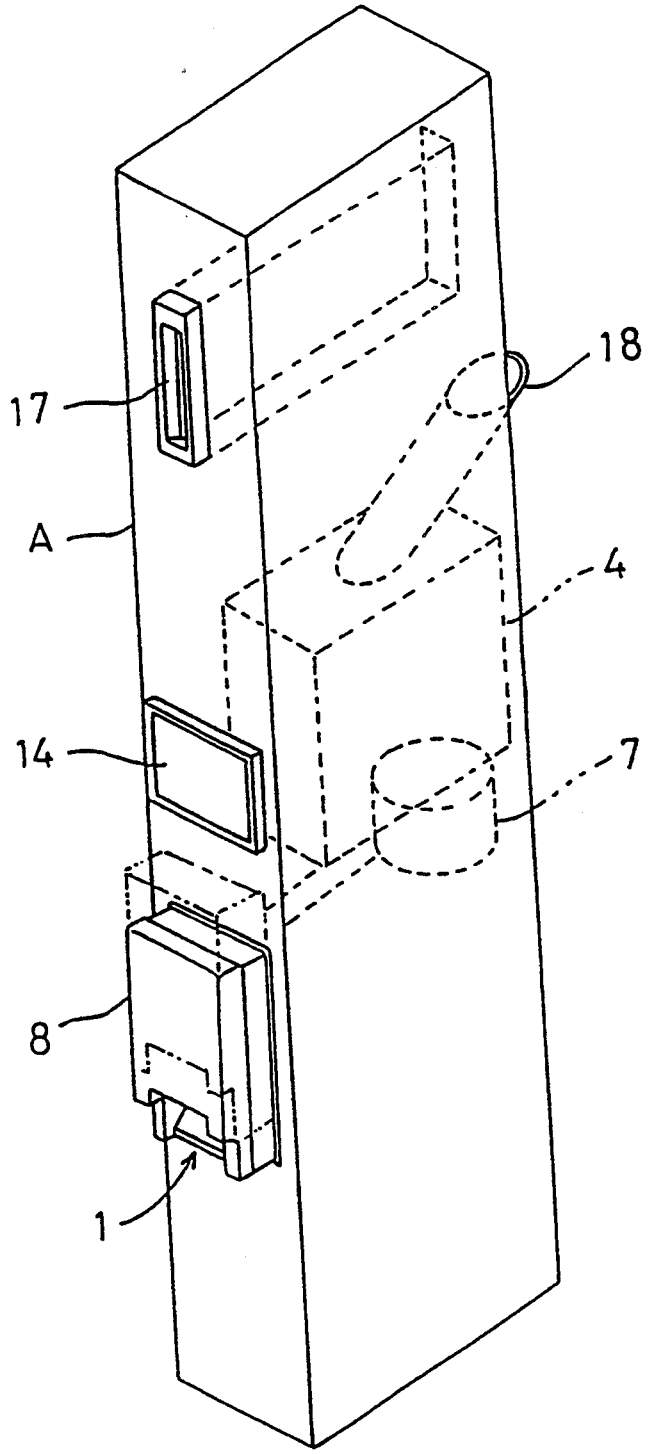
FIG. 3 is a perspective view of the token dispenser.
Figure 4:
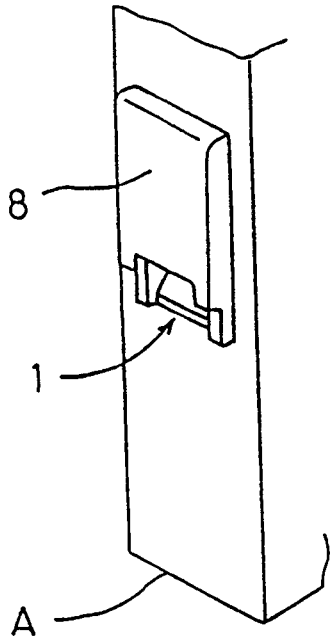
FIG. 4 is a fragmentary perspective view illustrating the operation of the dispenser.
Figure 5:
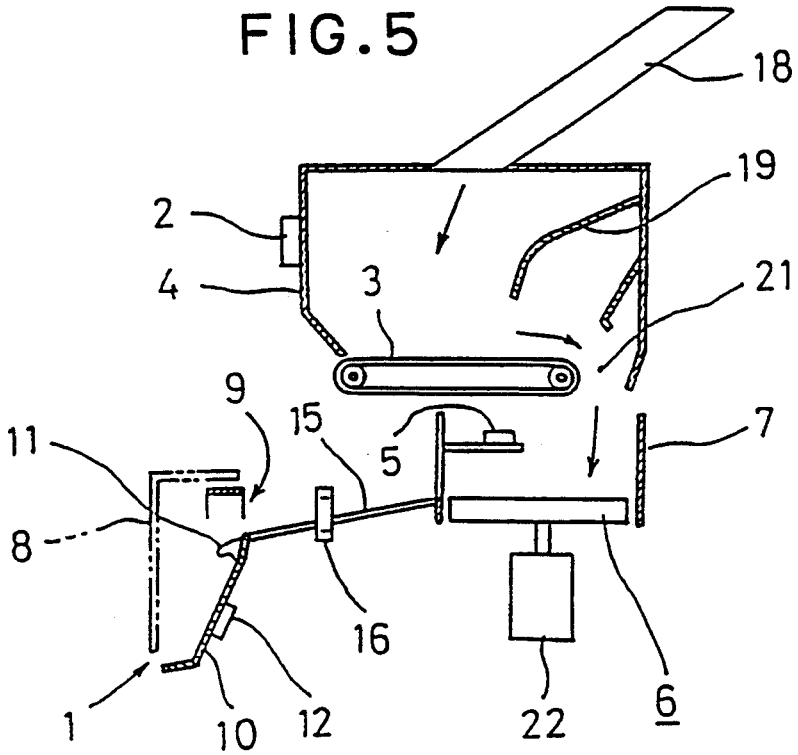
FIG. 5 is a side cross-sectional view showing the internal structure of the dispenser.
Figure 6:
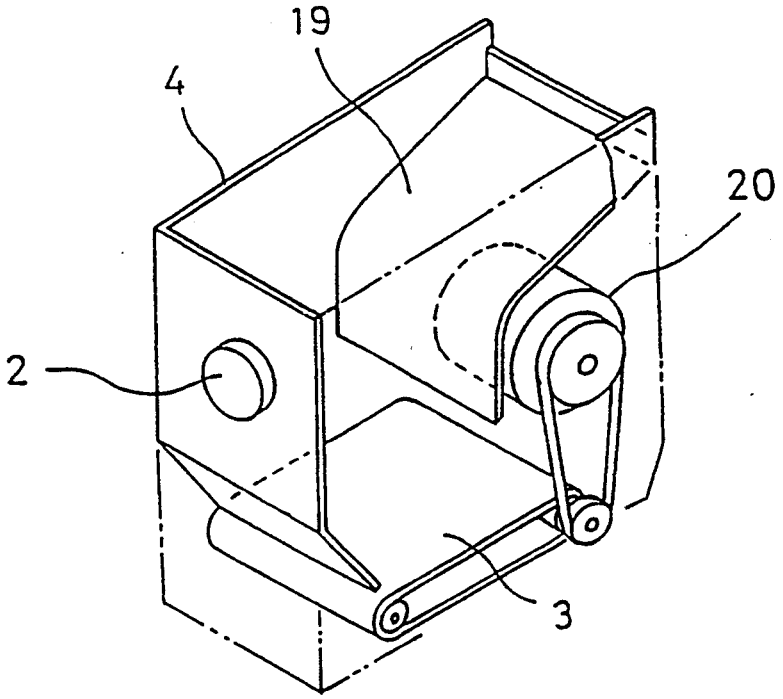
FIGS. 6, 7 and 8 are fragmentary enlarged perspective views respectively showing various portions.
Figure 7:
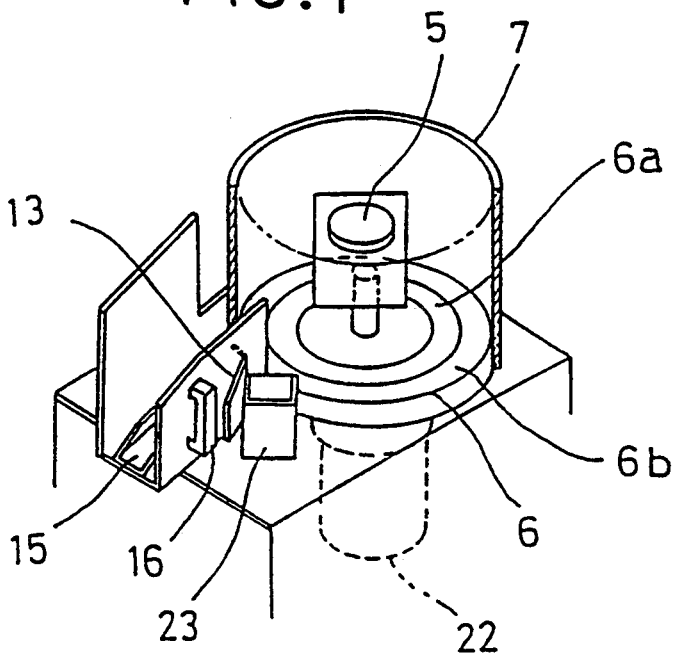
Figure 8:
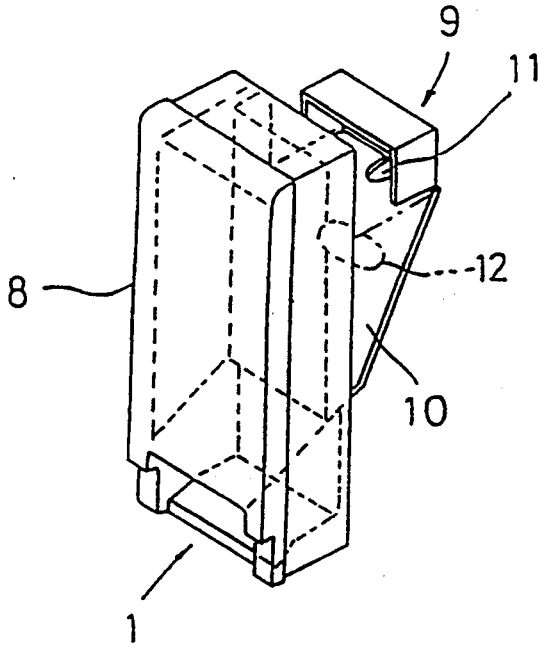
Figure 9:
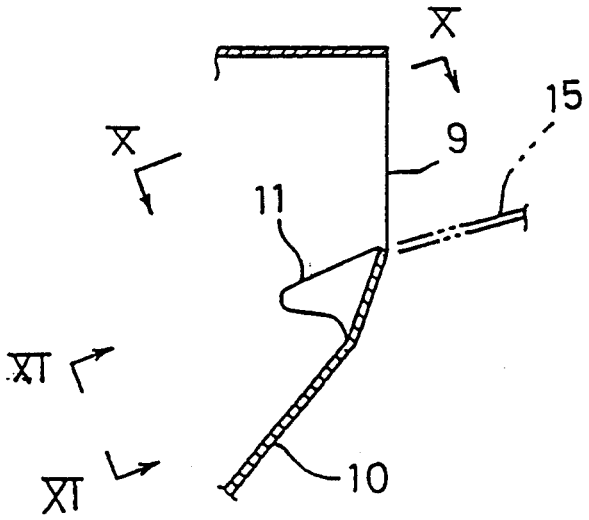
FIG. 9 is a side cross-sectional view showing a portion of FIG. 8.
Figure 10:
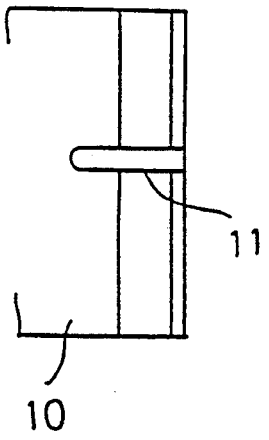
FIGS. 10 and 11 are cross-sectional views taken along lines X—X and XI—XI, respectively.
Figure 11:
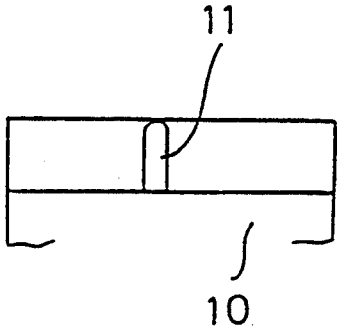

FIG. 2 is a front view of a game token dispenser A to be installed next to slot machines in a slot machine island. On a front upper portion of the token dispenser A, a paper currency insertion slot 17, through which a 1000-yen currency note may be inserted for 50 tokens, is provided. Below the paper currency insertion slot 17, there is provided a display 14 for displaying whether or not it is possible to dispense tokens and the number of tokens dispensed. Over a token receiving port 1 under the display 14, a sliding closure 8 is mounted so as to slide vertically between a solid-line position of FIG. 4 in which the closure 8 is pushed downwardly and a phantom-line position of FIG. 3 in which the closure 8 is pulled upwardly, thereby closing and opening token receiving port 1.

Inside the token dispenser A, a preliminary hopper 4 is mounted for receiving tokens from a token reservoir B in the slot machine island via a chute 18. The preliminary hopper 4 has a volume capable of containing about 300 tokens and is equipped with an approach sensor 2 attached to the side portion of the preliminary hopper 4 for detecting the level of tokens therein. On the bottom portion of the preliminary hopper 4, a token conveying means 3 in the form of a conveyer belt is mounted horizontally, being driven by a motor 20 situated under a downward guide plate 19. At the trailing end of the conveying means 3, a downwardly directed outlet 21 is provided.

Below the outlet 21, a second dispensing hopper 7 in the form of a circular tube is provided for containing 150 to 200 tokens. On the upper portion of the dispensing hopper 7, an approach sensor 5 is mounted for detecting the level of tokens in the dispensing hopper 7. On the bottom portion of the dispensing hopper 7, a discharging means 6 is mounted, including a rotary drum **6*b* and a ring-shape friction belt 6*a* wound around a circumferential surface of the rotary drum 6*b*. When driven by a motor 22, the discharging means 6 discharges tokens one by one into a dispensing path 15 connected with the periphery of the dispensing hopper 7** and communicating therewith.

From a gate-shape inlet communicating with the trailing end of the dispensing path 15, a receiving plate 10 slopes downwardly toward the token receiving port 1 inside the closure 8. Centrally from the upper end of the receiving plate 10 under the inlet 9, a tongue 11 extends into the closure 8. An approach sensor 12 mounted on the receiving plate 10 for detecting the presence/absence of tokens, and a counting sensor 16 is mounted in the dispensing path 15 for counting tokens as they pass through. Also in the dispensing path 15 at a position adjacent to the periphery of the dispensing hopper 7 but sequentially before the sensor 16, a shutter 13 is mounted. In response to the energization of a solenoid 23, the shutter 13 is closed to stop dispensing tokens.

Figure 12:
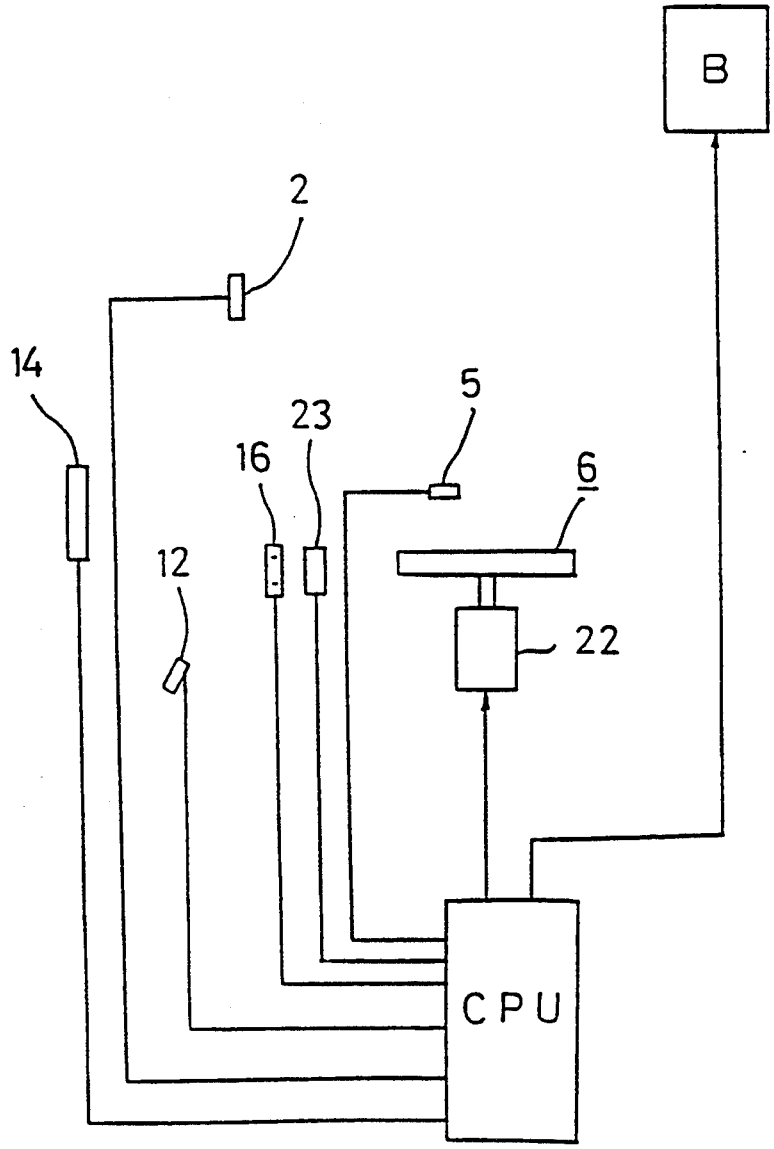
FIG. 12 is a circuit diagram showing a circuit used in the dispenser.

FIG. 12 shows a circuit to be used in this invention and to be controlled by a CPU. In response to the level detection by the individual approach sensor 2, a supplier of the token reservoir B is operable to introduce tokens to a predetermined level. In response to the level detection by the approach sensor 5, the motor 20 is rotated to introduce the tokens on the conveying means 3 into the dispensing hopper 7 until the level of the tokens in the hopper 7 reaches a predetermined value. In response to the energization of the approach sensor 12, the presence/absence of tokens in the receiving port 1 is indicated on the display. Meanwhile the counting sensor 16 counts the tokens dispensed. If the previously dispensed tokens are stored in the receiving port 1 for a predetermined time, it is possible to display the information message such as "now dispensing" and, at the same time, to prohibit insertion of any more paper currency. Therefore, if tokens are supplied to the preliminary hopper 4 from the token reservoir B via the chute 18, the preliminary hopper 4 stores the tokens and, at the same time, the approach sensor 2 detects the level of the tokens in the preliminary hopper 4. Then when the level of tokens reaches a predetermined value, a shutter of the token reservoir is closed to stop supplying tokens from the chute 18. The conveying means 3 conveys tokens to the outlet 21 to supply them to the dispensing hopper 7.

Inside the hopper 7, the approach sensor 5 detects the level of the tokens, and when the level reaches a predetermined value, the motor 20 of the conveying means 3 is stopped to keep the amount of tokens in the dispensing hopper 7 constant. The discharging means 6 discharges tokens of the dispensing hopper 7 one by one into the dispensing path 15. The tokens thus discharged into the dispensing path 15 are counted by the counting sensor 16, pass the inlet 9 and move over the tongue 11, and finally end up in the receiving port 1 whose bottom portion is constituted by the receiving plate 10. Then by moving the closure 8 upwardly to open it, the tokens inside the closure 8 can be dispensed from the receiving port 1, and the number of tokens counted by the counting sensor 16 is indicated on the display 14. At that time, if more than the number of (50) tokens equivalent to 1000 yen are counted, the shutter 13 is closed to stop dispensing any more tokens and, at the same time, "stop dispensing" is displayed. If any of the approach sensors 2, 5, 12 detects a non-smooth supply of tokens, "clogging" is displayed so that an arcade keeper can take appropriate action to solve the problem. If continuous dispensing is to be done with the previously dispensed tokens left not taken out the token receiving port, dispensing of tokens can be done up to two times whereupon any further token dispensing and any further money inserting will be prohibited and, at the same time, clientele will be urged to remove the tokens from the port.

Usefulness of the Invention

According to this invention, as tokens are supplied to the preliminary hopper 4 from the token reservoir, the preliminary hopper 4 stores them and, at the same time, detects the level of tokens. The conveying means 3 then conveys the tokens to the dispensing hopper 7. In the dispensing hopper 7, in which the level of the tokens is detected, a predetermined number of tokens are dispensed one by one to the token receiving port 1 by the discharging means 6. It is therefore possible to dispense the number of tokens equivalent to the amount of the inserted money reliably, without troubling an arcade keeper to clear any clogging as after occurs in the conventional dispenser.

Further, since the tokens are counted precisely by the counting sensor 16 as they pass through the dispensing path 15 and, at the same time, the number of the dispensed tokens is indicated on the display 14, it is possible to improve services to clientele. Since the approach sensors 2, 5, 12 disposed respectively at the preliminary hopper 4, the dispensing hopper 7 and the token receiving port 1 detect the presence/absence of tokens, the shutter-14 will be closed to stop dispensing the tokens at the time a problem arises, so that an arcade keeper can take appropriate measures. Thus it is possible to realize a high-performance game token dispenser which can improve the confidence of the amusement arcade without disconcerting the clientele.

Furthermore, according to this invention, since with the dispensed tokens remaining in the receiving port, discrimination is made as to whether or not it is possible to carry out the next dispensing operation, it is possible to prevent the tokens from over flowing out of the receiving port, which would be a cause of mishaps. Also since continuous dispensing is possible up to two times, clientele can purchase tokens in a trouble free manner.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A game token dispenser equipped with a token hopper for dispensing a predetermined number of tokens supplied from a token reservoir to a token receiving port, characterized in that:

said token hopper is divided into a sequentially functioning preliminary hopper and a dispensing hopper;

said preliminary hopper having a sensor for detecting whether or not there is any token received from the reservoir, and conveying means for conveying the token from said preliminary hopper to said dispensing hopper; and said dispensing hopper having a sensor for detecting whether or not there is any token received from said preliminary hopper and a total amount of tokens in said dispensing hopper, and means for discharging the tokens one by one to the token receiving port.

2. A game token dispenser according to claim 1, wherein:

said conveying means is a conveyer belt.

3. A game token dispenser according to claim 1, wherein:

said discharging means includes a rotary drum and a ring-shape friction belt wound around a circumferential surface of said rotary drum.

4. A game token dispenser according to claim 1, wherein said preliminary hopper sensor and said dispensing hopper sensor each further detect a non-smooth supply of tokens.

5. A game token dispenser, comprising:

a housing;

a preliminary hopper, to which tokens are to be supplied from a token reservoir;

a dispensing hopper having a discharging means for dispensing a predetermined number of the tokens, which are received by said dispensing hopper from said preliminary hopper, one by one to a token dispensing port;

a display on a front surface of said housing for displaying whether or not it is possible to dispense the tokens and the number of the tokens dispensed; and a counting sensor disposed in a dispensing path between the dispensing hopper and the token dispensing port for counting the tokens dispensed.

6. A game token dispenser according to claim 5, wherein:

three sensors, each for detecting tokens, are disposed respectively adjacent to the preliminary hopper, the dispensing hopper and the token dispensing port, and a shutter openable and closable for stopping the tokens from being dispensed is disposed between the dispensing hopper and said counting sensor.

7. A game token dispenser according to claim 6, wherein:

a position at which the tokens get clogged is discriminated by a correspondingly adjacent one of the three sensors so as to be subsequently displayed.

8. A game token dispenser equipped with a hopper for dispensing a predetermined number of tokens in exchange for paper currency inserted therein, which tokens are dispensed from a token reservoir, one by one to a token dispensing port, characterized in that:

said dispenser further includes a counting sensor disposed in a dispensing path between the hopper and the token dispensing port for counting a number of tokens dispensed, and a sensor disposed adjacent to the token dispensing port for detecting whether tokens dispensed therethrough overlap one another, whereby the sensor can discriminate whether or not the tokens are stored in the token dispensing port for a predetermined time, and when a predetermined number of tokens as detected by said sensor are dispensed upon discrimination that the tokens are present in the token dispensing port, the dispenser displays an information message and acts to prohibit insertion of additional paper currency.

9. A game token dispenser for dispensing a predetermined number of game tokens, which are supplied from a token reservoir, to a token dispensing port, comprising:

a housing;

a token hopper for storing tokens supplied from said token reservoir, and for dispensing a predetermined number of tokens to said token dispensing port in response to a token dispensing request, wherein said token hopper consist of a preliminary hopper and a dispensing hopper, said preliminary hopper temporarily stores the tokens supplied from said token reservoir, said dispensing hopper temporarily stores tokens supplied from said preliminary hopper and also dispenses said predetermined number of tokens to said token dispensing port, said preliminary hopper includes a first sensor for detecting the level of tokens stored therein, and conveying means for conveying tokens from said preliminary hopper to said dispensing hopper, said dispensing hopper includes a second sensor for detecting the level of tokens stored therein, and discharging means for dispensing tokens one by one to said token dispensing port; and control means for controlling (i), based on the level of tokens detected by said first sensor, said supply of the tokens to said preliminarily hopper so that a predetermined number of tokens are stored therein, and (ii), based on the level of tokens detected by said second sensor, said supply of tokens to said dispensing hopper so that a predetermined number of tokens may be stored therein, and (iii) the dispensing of said predetermined number of tokens to said token dispensing port.

10. A game token dispenser according to claim 9, further comprising:

a counting sensor, disposed in a dispensing path between said dispensing hopper and said token dispensing port, for counting the number of tokens dispensed and sending count information corresponding to the number of tokens counted to said control means; and a display provided at a front side of said housing for displaying display information;

wherein said control means, based on said count information controls the display such that the number of tokens dispensed is displayed.

11. A game token dispenser according to claim 10, further comprising:

a third sensor provided at said token dispensing port for detecting a state when tokens are supplied at said token dispensing port; and wherein said control means, based on the state detected by said third sensor, controls said display such that the display indicates that the tokens are now being dispensed.

12. A game token dispenser according to claim 11, wherein said housing has a paper currency insertion slot at said front side thereof; and said control means, based on a signal from said third sensor, controls said paper currency insertion slot so as to prohibit insertion of paper currency.

* * * * *